US007552716B2

(12) United States Patent
Osaki

(10) Patent No.: US 7,552,716 B2
(45) Date of Patent: Jun. 30, 2009

(54) COMMON RAIL FUEL INJECTION SYSTEM DESIGNED TO AVOID ERROR IN DETERMINING COMMON RAIL FUEL PRESSURE

(75) Inventor: Masatoyo Osaki, Anjo (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/509,846

(22) Filed: Aug. 25, 2006

(65) Prior Publication Data

US 2007/0044764 A1 Mar. 1, 2007

(30) Foreign Application Priority Data

Aug. 25, 2005 (JP) ..... 2005-243556

(51) Int. Cl.
*F02M 69/54* (2006.01)

(52) U.S. Cl. ..... 123/457; 123/456; 123/466

(58) Field of Classification Search ..... 73/119 A, 73/120; 123/494, 495, 457, 456, 466
See application file for complete search history.

(56) References Cited

U.S. PATENT DOCUMENTS 3,702,469 A * 11/1972 Golja ..... 340/662
4,450,812 A * 5/1984 Otsuka et al. ..... 123/438
4,594,537 A * 6/1986 Arifian et al. ..... 318/564
6,024,064 A * 2/2000 Kato et al. ..... 123/179.17
6,578,426 B2 6/2003 Imai et al.
6,757,608 B2 * 6/2004 Gross et al. ..... 701/115
6,932,743 B2 * 8/2005 Zieles et al. ..... 477/187
2004/0007213 A1 * 1/2004 Oono ..... 123/495
2004/0055575 A1 * 3/2004 McCarthy et al. ..... 123/457

FOREIGN PATENT DOCUMENTS

EP 0716223 B1 4/2000
JP 8-237761 9/1996
JP 2002-195902 7/2002
JP 2002-276500 9/2002

* cited by examiner

*Primary Examiner*—Stephen K Cronin
*Assistant Examiner*—J. Page Hufty
(74) *Attorney, Agent, or Firm*—Nixon & Vanderhye P.C.

(57) ABSTRACT

A common rail fuel injection system includes an electronic control unit and a fuel pressure sensor. The electronic control unit is equipped with a power supply circuit which supplies a power supply voltage to the fuel pressure sensor through a harness. The power supply voltage is used in the pressure fuel sensor as a drive voltage to drive a sensor element of the fuel pressure sensor. The electronic control unit monitors an output voltage of the fuel pressure sensor to determine the pressure of fuel in a common rail and also monitors the drive voltage applied to the fuel pressure sensor to determine whether the drive voltage is undesirably lower than the power supply voltage or not. If such a condition is encountered, the electronic control unit takes measures to avoid an excessive rise in pressure in the common rail to protect the common rail physically.

8 Claims, 7 Drawing Sheets

COMMON RAIL FUEL INJECTION SYSTEM DESIGNED TO AVOID ERROR IN DETERMINING COMMON RAIL FUEL PRESSURE

CROSS REFERENCE TO RELATED DOCUMENT

The present application claims the benefit of Japanese Patent Application No. 2005-243556 filed on Aug. 25, 2005, the disclosure of which is incorporated herein by reference.

BACKGROUND OF THE INVENTION

1. Technical Field of the Invention

The present invention relates generally to a common rail fuel injection system equipped with a fuel pressure sensor working to measure the pressure of fuel within a common rail and an electronic control unit working to monitor an output of the fuel pressure sensor to determine the pressure within the common rail, and more particularly to such a system designed to avoid an error in determining the pressure within the common rail.

2. Background Art

Japanese Patent First Publication No. 2002-276500 discloses one example of typical common rail fuel injection systems which includes a common rail in which fuel is accumulated under a given high pressure and fuel injectors working to inject the fuel in the common rail into the engine. The common rail has installed therein a fuel pressure sensor which measures the pressure of the fuel within the common rail. The system works to monitor an output of the fuel pressure sensor and control the quantity of fuel to be discharged from a high-pressure pump to the common rail to bring the pressure in the common rail into agreement with a target value.

The fuel pressure sensor is coupled with an electronic control unit through a harness. The electronic control unit is equipped with a power supply circuit designed to produce a constant power supply voltage from a storage battery and supply it to the fuel pressure sensor.

The fuel pressure sensor has installed therein a sensor element which is sensitive to the pressure in the common rail. The sensor element is made of a semiconductor designed to exhibit the piezoresistance effect in which the resistance value changes upon deformation thereof. Specifically, the sensor element has an electric resistivity which changes as a function of a change in the pressure in the common rail. This resistivity change is found by using voltages applied to and outputted from the sensor element. The voltage applied to the sensor element is the constant power supply voltage, as produced by the power supply circuit. The electronic control unit monitors the voltage outputted by the fuel pressure sensor and determines the pressure in the common rail by look-up using a map listing an experimentally obtained relation between the pressure of fuel within the common rail and the output voltage of the fuel pressure sensor. The electronic control unit controls the quantity of fuel supplied to the common rail to bring the determined pressure in the common rail into agreement with a target value under feedback control.

The voltage applied to the sensor element may drop below the power supply voltage produced by the power supply circuit due to addition of a resistor in the harness connecting between the fuel pressure sensor and the electronic control unit in order to increase an output of the engine or disconnection of the harness from the fuel pressure sensor or the electronic control unit. This will cause the voltage, as outputted by the fuel pressure sensor, to have a level lower than that indicating an actual value of the pressure in the common rail. The electronic control unit, thus, computes the value of the pressure in the common rail in error as being smaller than an actual value thereof. This causes an excessive quantity of fuel to be fed from the high-pressure pump to the common rail, so that the pressure of fuel within the common rail is elevated above the target value, thus resulting in an undesirable rise in output of the engine, which may lead to physical damage to or a decrease in service life of the common rail.

SUMMARY OF THE INVENTION

It is therefore a principal object of the invention to provide a common rail fuel injection system designed to avoid an error in determining the pressure in a common rail.

It is another object of the invention to provide a common rail fuel injection system designed to avoid an error of fuel pressure feedback control arising from, for example, remodeling of an electronic control unit and a fuel pressure sensor in order to increase an output of an engine, thereby minimizing physical damage to the common rail to ensure a desired service life thereof.

According to one aspect of the invention, there is provided a common rail fuel injection system which may be employed for automotive common rail diesel engines. The common rail fuel injection system comprises: (a) a common rail storing therein fuel under a given pressure which is to be injected into an engine; (b) a fuel pressure sensor equipped with a sensor element which works to output a voltage signal as a function of a pressure of the fuel within the common rail; (c) an electronic control unit equipped with a power supply circuit which is designed to supply a constant power supply voltage to the fuel pressure sensor through a harness, the constant power supply voltage being used in the fuel pressure sensor as a drive voltage applied to drive the sensor element, the electronic control unit working to feedback-control the pressure of the fuel within the common rail based on the voltage signal, as outputted from the fuel pressure sensor; (d) a voltage sampling circuit working to sample the drive voltage applied to the sensor element of the fuel pressure sensor; and (e) a voltage error monitor working to monitor whether the drive voltage, as sampled by the voltage sampling circuit, is in error or not.

If a resistor is added to the harness or a disconnection of the hardness with the electronic control unit or the fuel pressure sensor, it will result in an undesirable change in the drive voltage applied to the sensor element of the fuel pressure sensor. In such an event, the voltage error monitor determines that the drive voltage, as sampled by the voltage sampling circuit, is in error to avoid an error in computing the pressure in the common rail. This permits the electronic control unit to avoid an excessive rise in the pressure in the common rail, thereby protecting the common rail from physical damage to ensure a desired service life of the common rail.

In the preferred mode of the invention, the electronic control unit determines a target fuel pressure with which the pressure within the common rail is brought into agreement under feedback control and corrects the target fuel pressure using the drive voltage, as sampled by the voltage sampling circuit, thereby placing the pressure in the common rail within an permissible range.

When it is determined by the voltage error monitor that the drive voltage, as sampled by the voltage sampling circuit, is in error, the electronic control unit may correct the target fuel pressure with which the pressure within the common rail is brought into agreement under feedback control to a value which is at least required to ensure an operation of the engine.

When it is determined by the voltage error monitor that the drive voltage, as sampled by the voltage sampling circuit, is in error, the electronic control unit may stop the feedback control to control the pressure of the fuel within the common rail.

The voltage error monitor works to monitor whether the drive voltage, as sampled by the voltage sampling circuit, is in error or not during a steady operation of the engine in which an output of the fuel pressure sensor is stable.

The harness connecting between the electronic control unit and the fuel pressure sensor includes a reference line through which the electronic control unit and the fuel pressure sensor are placed at a given reference potential, a first signal line through which the voltage signal is transmitted from the fuel pressure sensor to the electronic control unit, and a second signal line through which the drive voltage is transmitted from the fuel pressure sensor to the voltage sampling circuit installed in the electronic control unit.

The common rail fuel injection system may further comprises an arithmetic circuit which includes the voltage sampling circuit and the voltage error monitor and is installed in the fuel pressure sensor. The arithmetic circuit works to output to the electronic control unit a signal indicating the fact that the drive voltage, as sampled by the voltage sampling circuit, is in error.

According to another aspect of the invention, there is provided a common rail fuel injection system which comprises: (a) a common rail storing therein fuel under a given pressure which is to be injected into an engine; (b) a fuel pressure sensor equipped with a sensor element which is driven by a drive voltage applied thereto to output a voltage signal as a function of a pressure of the fuel within the common rail; (c) an electronic control unit equipped with a power supply circuit which is designed to supply an electric power to the fuel pressure sensor through a harness, the electronic control unit working to feedback-control the pressure of the fuel within the common rail based on the voltage signal, as outputted from the fuel pressure sensor; and (d) a constant voltage circuit which is installed in the fuel pressure sensor and works to convert the electric power, as supplied from the power supply circuit of the electronic control unit, into an electric power of a constant voltage which is applied to the sensor element of the fuel pressure sensor as the drive signal to drive the sensor element.

Even when the voltage supplied to the fuel pressure sensor undergoes a change due to, for example, addition of a resistor to a connection between the fuel pressure sensor and the electronic control unit in order to increase an output of the engine, the power supply circuit installed in the fuel pressure sensor serves to produce the constant power supply voltage, thus ensuring the stability in producing an output of the fuel pressure sensor. This avoids an error in determining the pressure in the common rail.

In the preferred mode of the invention, the electronic control unit works to cyclically vary a level of the electric power to be supplied to the fuel pressure sensor. The electronic control unit and the fuel pressure sensor include communication circuits, respectively, which establish communication therebetween in synchronization with a variation in the level of the electric power. Accordingly, for instance, when an output of the fuel pressure sensor is altered intentionally in order to elevate the pressure in the common rail to increase the output of the engine, it will require a need for analysis of signal coding in the communication between the fuel pressure sensor and the electronic control unit to transmit a command signal to the electronic control unit which commands it to elevate the pressure in the common rail, thereby resulting in increased difficulty in altering the output of the fuel pressure sensor improperly.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
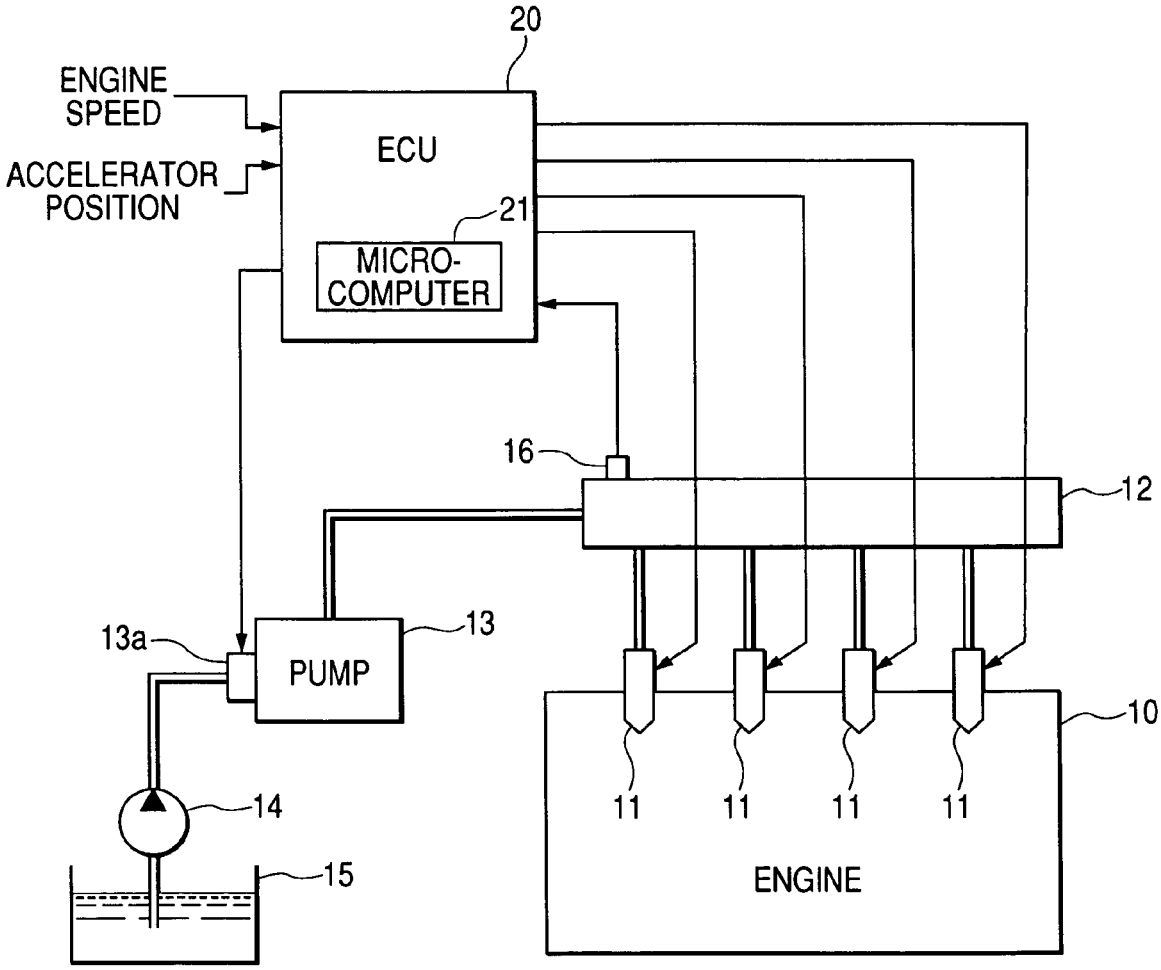
FIG. 1 is a block diagram which shows a common rail fuel injection system according to the first embodiment of the invention.

Referring to the drawings, wherein like reference numbers refer to like parts in several views, particularly to FIG. 1, there is shown a fuel injection system according to the first embodiment of the invention which is designed as a common rail fuel injection system (also called an accumulator injection system) working to control injection of fuel into multi-cylinder diesel engines.

The fuel injection system includes solenoid-operated injectors 11 each for one of cylinders of the engine 10. The injectors 11 are hydraulically connected to a common rail 12 which serves as a fuel accumulator. A high-pressure pump 13 is connected to the common rail 12 and works to supply fuel to the common rail 12 and accumulate it at a pressure substantially equivalent to a required fuel injection pressure. A solenoid-operated suction control valve 13*a* is installed on the high-pressure pump 13. The high-pressure pump 13 sucks the fuel pumped by a feed pump (i.e., a low-pressure pump) 14 out of a fuel tank 15 through the suction control valve 13*a*. The common rail 12 has installed therein a fuel pressure sensor 16 which is designed to measure the pressure of the fuel within the common rail 12 (will also be referred to as a common rail pressure below) and output a signal indicative thereof to an electronic control unit (ECU) 20. The common rail pressure is usually on the order of 20 Mpa to 180 Mpa. The withstanding pressure of the common rail 12 is usually on the order of 200 Mpa. The common rail 12 has also a solenoid-operated or mechanically-operated pressure reducing valve (not shown) which is to be opened when the pressure in the common rail 12 has exceeded a given permissible level to drain the fuel from the common rail 12.

The ECU 20 is equipped with a microcomputer 21 which is of a typical structure consisting of a CPU, a ROM, a RAM, etc. The ECU 20 monitors an output of the fuel pressure sensor 16 and information on vehicle running conditions such as the speed of the engine 10 and the position or stroke of an accelerator pedal. The microcomputer 21 works to analyze the monitored vehicle running conditions to determine optimum injection timings and an optimum quantity of the fuel to be injected into the engine 10 and output injection control signals to the injectors 11. Each of the injectors 11 is responsive to one of the injection control signals to inject the quantity of the fuel at a timing, as determined by the microcomputer 21.

The microcomputer 21 also monitors instant values of the speed of the engine 10 and the injection quantity to determine a target value of the pressure in the common rail 12 and regulates the amount of the fuel discharged from the high-pressure pump 13 to bring the pressure in the common rail 12 into agreement with the target value under feedback control. Specifically, the microcomputer 12 determines a target amount of the fuel to be discharged from the high-pressure pump 13 which is required to compensate for a difference between an actual value of the pressure in the common rail 12 and the target value thereof to control an open position of the suction control valve 13*a* of the high-pressure pump 13.

Figure 2:
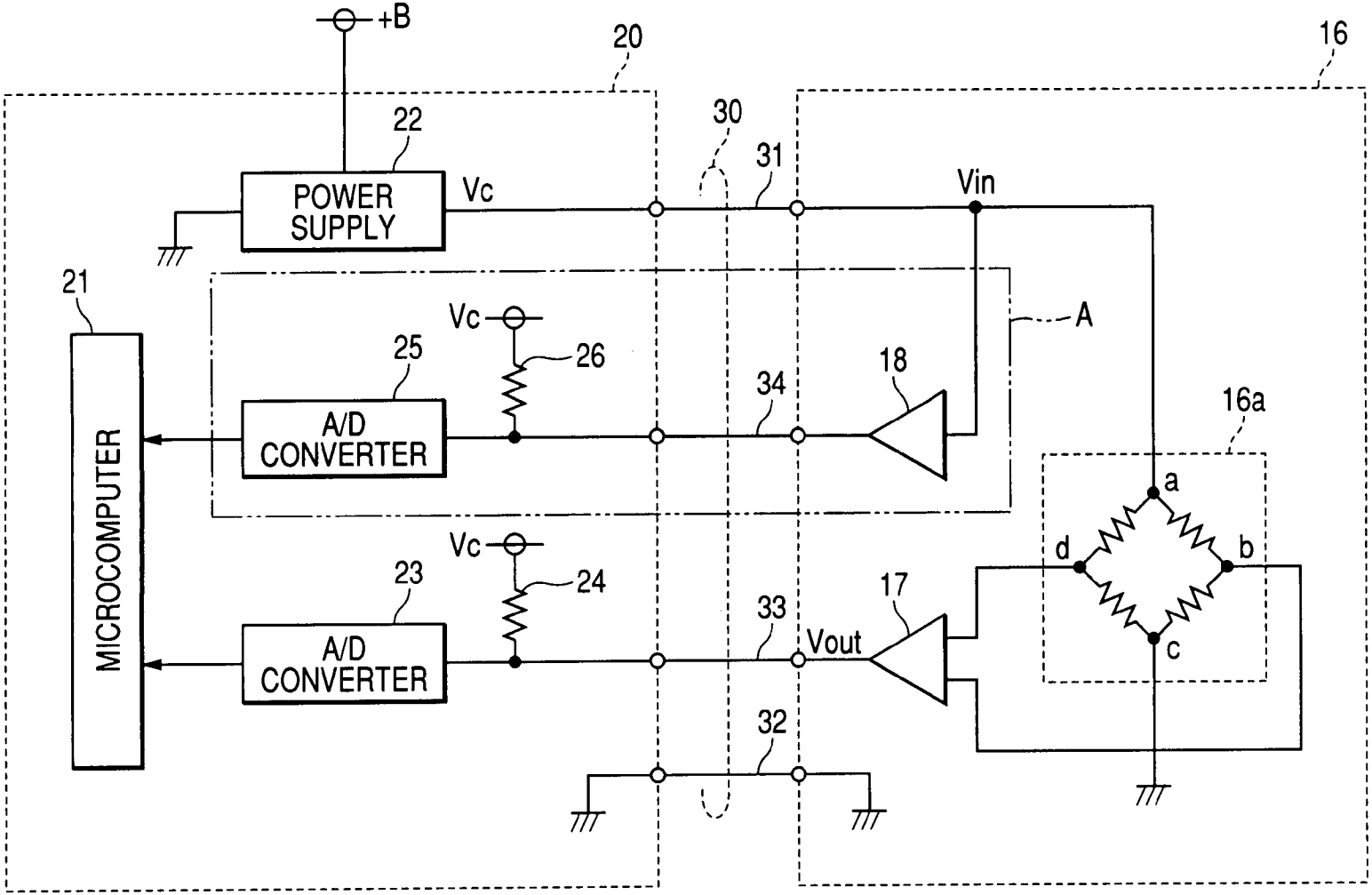
FIG. 2 is a circuit diagram which shows internal structures of an electronic control unit and a fuel pressure sensor which are installed in the common rail fuel injection system of FIG. 1.

FIG. 2 illustrates internal structures of the fuel pressure sensor 16 and the ECU 20. The fuel pressure sensor 16 and the ECU 20 are coupled with each other through a harness 30. The harness 30 consists of four wires and connectors (not shown) joined to ends of the wires. The fuel pressure sensor 16 and the ECU 20 also have connectors mating with the connectors of the harness 30.

Parts of the fuel pressure sensor 16 and the ECU 20, as enclosed by a chain line A, are what constitute the feature of the invention. Other parts are known circuit arrangements and will be first discussed below.

The ECU 20 includes a power supply circuit 22, A/D converters 23 and 25, and resistors 24 and 26. The power supply circuit 22 is coupled with a terminal +B of a storage battery and works to produce a constant voltage Vc of, for example, 5V which is, in turn, supplied to the fuel pressure sensor 16 through the power supply line 31 of the harness 30. The fuel pressure sensor 16 and the ECU 20 are placed at a common reference potential through the reference potential line 32.

Figure 3:
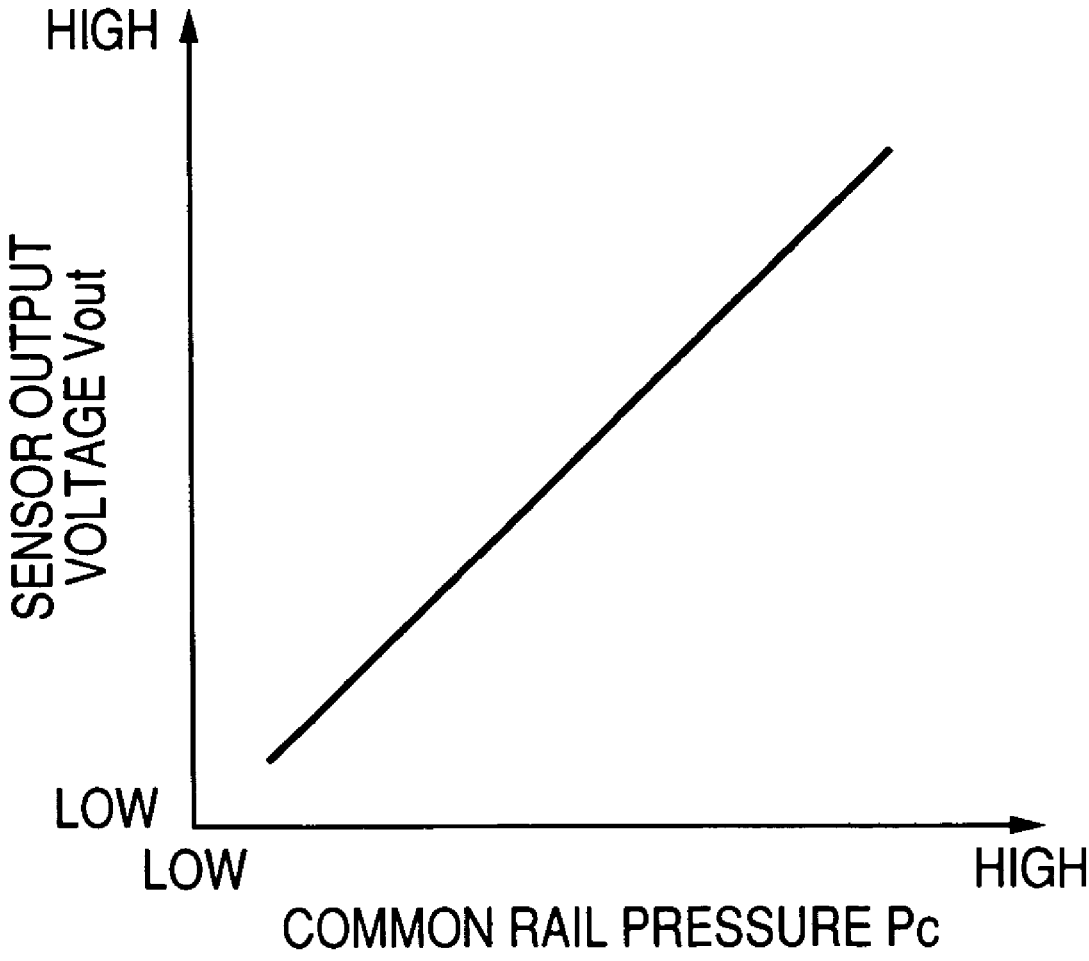
FIG. 3 is a map listing a relation between a voltage signal outputted from a fuel pressure sensor and a common rail pressure which is used in determining the pressure of fuel within a common rail.

The fuel pressure sensor 16 includes a sensor element 16*a* which is sensitive to the pressure in the common rail 12 (which will be also referred to as a common rail pressure Pc below). The sensor element 16*a* is made of a silicon semiconductor designed to exhibit the piezoresistance effect in which the resistance value changes upon deformation thereof. Specifically, the sensor element 16*a* has an electric resistivity which changes as a function of a change in the common rail pressure Pc. This resistivity change may be found by using the voltage applied to diametrically opposed terminals a and c of the bridge circuit and the voltage applied to diametrically opposed terminals b and d of the bridge circuit. The voltage applied to the terminals a and c is kept constant. A change in the common rail pressure Pc will, therefore, result in a change in the voltage between the terminals b and d. The fuel pressure sensor 16 samples the voltage between the terminals b and d through a differential amplifier 17 and output it in the form of a voltage signal Vout. FIG. 3 demonstrates a relation between the common rail pressure Pc and the voltage signal Vout. The relation shows that the voltage level of the voltage signal Vout increases as an increase in the common rail pressure Pc.

The voltage signal Vout, as produced by the fuel pressure sensor 16, is inputted to the ECU 20 through the signal line 33 of the harness 30 and sampled by the microcomputer 21 through the A/D converter 23. The microcomputer 21 works to analyze the voltage signal Vout to determine the common rail pressure Pc based on the voltage-pressure relation, as demonstrated in FIG. 3. The signal line 33 is pulled up to the power supply voltage Vc through the resistor 24 (e.g., 200 kΩ) within the ECU 20.

In order to rise the pressure in the common rail 12 to increase an output of the engine 10 intentionally or illegally, a resistor may be disposed in the power supply line 31 through which the power supply circuit 22 supplies the electric power to the fuel pressure sensor 16 to produce a voltage drop across the resistor, causing an internal drive voltage Vin applied to the sensor element 16*a* to be lower than the power supply voltage Vc. This will cause the voltage signal Vout, as outputted by the fuel pressure sensor 16, to have a level lower than that indicating an actual value of the common rail pressure Pc. The microcomputer 21, thus, computes the value of the common rail pressure Pc as being smaller than the actual value thereof and controls the high-pressure pump 13 to elevate the pressure of fuel within the common rail 12 above the target value to increase the output of the engine 10 under the fuel pressure feedback control. This may, however, lead to physical damage to or a decrease in service life of the common rail 12.

In order to monitor such altering or an error of the internal drive voltage Vin of the fuel pressure sensor 16, the fuel injection system includes an internal drive voltage monitor, as enclosed by the chain line A in FIG. 2. Specifically, the internal drive voltage monitor consists of an operational amplifier 18, the A/D converter 25, and the resistor 26. The operational amplifier 18 samples and outputs the internal drive voltage Vin to the A/D converter 25 of the ECU 20 through the signal line 34. The microcomputer 21 monitors the internal drive voltage Vin, as converted into a digital form by the A/D converter 25, and determines whether the value of the internal drive voltage Vin is correct or not in comparison with the power supply voltage Vc. The signal line 34 is pulled up to the power supply voltage Vc through the resistor 26 (e.g., 200 kΩ) within the ECU 20.

Figure 4:
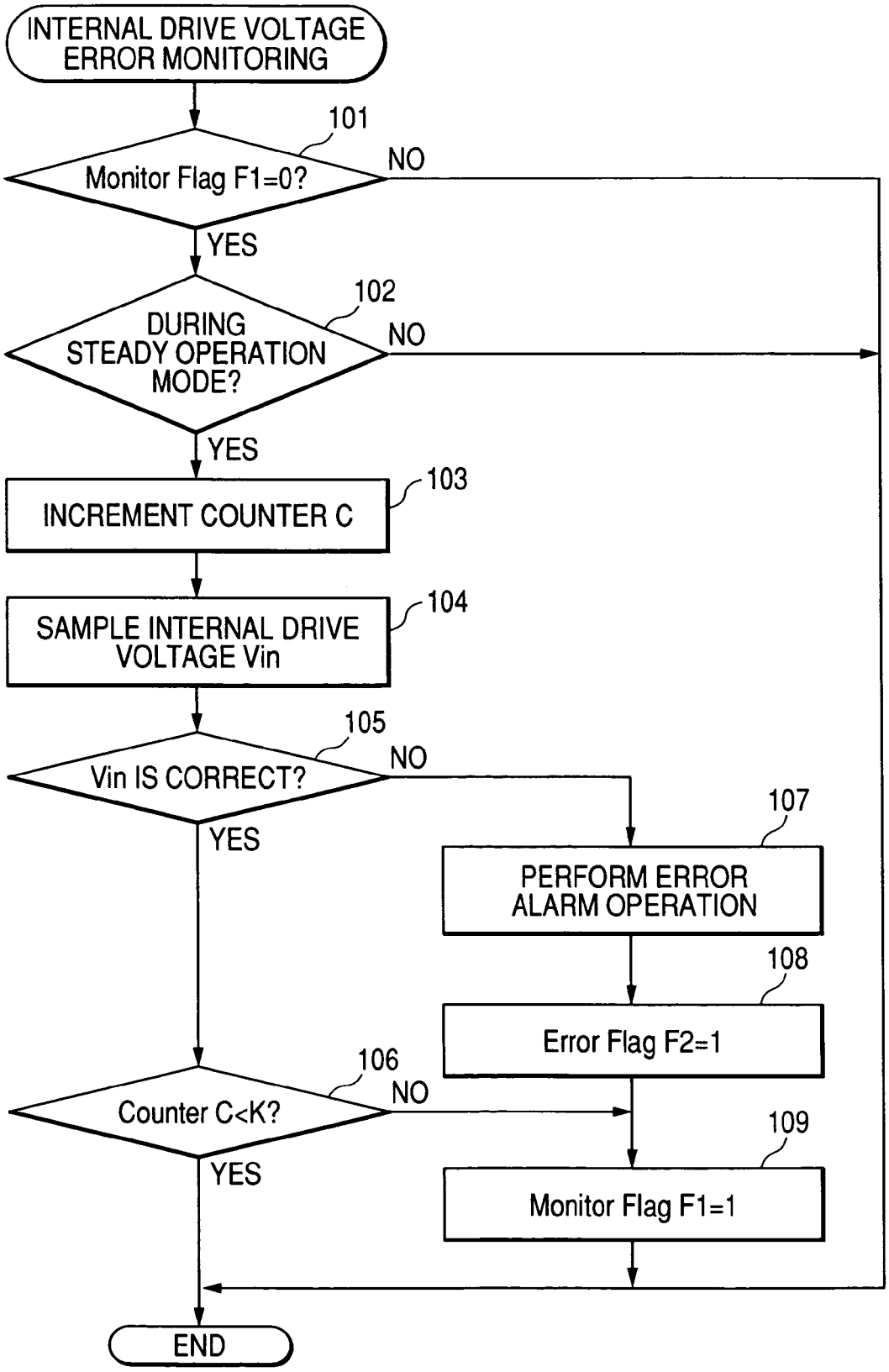
FIG. 4 is a flowchart of a sensor output error monitoring program to be executed in a cycle to determine whether the value of a drive voltage used to drive a fuel pressure sensor is in error or not.

FIG. 4 is a flowchart of a sensor output error monitoring program to be executed by the microcomputer 21 in a cycle of 10 msec. to determine whether the value of the internal drive voltage Vin of the fuel pressure sensor 16 is in error or not.

After entering the program, the routine proceeds to step 101 wherein it is determined whether a determination of whether the internal drive voltage Vin is in error or not has been already completed in a previous execution cycle of the program or not using a monitor flag F1. The above described resistor is usually installed in the power supply line 31 during stop of the engine 10. This program is, therefore, to be initiated after start-up of the engine. If the monitor flag F1 indicates zero (0) meaning that the internal drive voltage error determination is not yet completed, then the routine proceeds to step 102. Alternatively, if the monitor flag F1 indicates one (1) meaning that the internal drive voltage error determination has been already completed, then the routine terminates. Note that the monitor flag F1 is initialized to zero (0) upon turning on of the microcomputer 21.

In step 102, it is determined whether the engine 10 is in a steady mode of operation or not. This determination is made by monitoring the speed of the engine 10 or a change in the quantity of fuel injected into the engine 10 per unit time. The reason whey the internal drive voltage error determination is made during the steady operation mode of the engine 10 is for increasing the reliability of the internal drive voltage error determination. Specifically, the internal drive voltage error determination is made when the common rail pressure Pc is substantially kept constant, so that the voltage signal Vout, as produced by the sensor element 16*a*, is in a steady state. If a YES answer is obtained meaning that the engine 10 is in the steady operation mode, then the routine proceeds to step 103. Alternatively, if a NO answer is obtained, then the routine terminates.

In step 103, a counter C is incremented by one (1) which indicates the number of times the internal drive voltage error determination was made. In order to ensure the desired reliability in determining an error of the internal drive voltage Vin, the internal drive voltage error determination is to be made a given number of times K (e.g., 100 times). The counter C is, like the monitor flag F1, initialized to zero (0) in the initial operation of the microcomputer 21.

Subsequently, the routine proceeds to step 104 wherein the internal drive voltage Vin is sampled.

The routine proceeds to step 105 wherein it is determined whether the internal drive voltage Vin is correct or not. This determination is made by calculating a percentage of the internal drive voltage Vin to the power supply voltage Vc and determining whether a drop in the internal drive voltage Vin from the power supply voltage Vc is within 10% or not. If such a drop lies within 10%, it is determined that the internal drive voltage Vin is correct, that is, at an allowable level. The routine proceeds to step 106. Alternatively, if the drop lies out of 10% meaning that the internal drive voltage Vin is in error, then the routine proceeds to step 107.

In step 106, it is determined whether the internal drive voltage error determination was already made the given number of times K or not. This determination is made by determining whether the counter C is less than the given number of times K or not. If a YES answer is obtained, meaning that the internal drive voltage error determination is not yet made the number of times K, then the routine terminates. Upon a subsequent start-up of the engine 10, this program is initiated again. Alternatively, if a NO answer is obtained, then the routine proceeds to step 109.

If the resistor is disposed in the power supply line 31, and it is determined in step 105 wherein the internal drive voltage Vin is in error, the routine proceeds to step 107 wherein an error alarm operation is made. Specifically, in a diagnosis mode, the microcomputer 21 turns on a warning lamp informing a vehicle operator of the fact that the output of the fuel pressure sensor 16 is in error, that is, out of the allowable level and stores error data indicating the fact that the internal drive voltage Vin of the fuel pressure sensor 16 has dropped undesirably in an error diagnostic log memory such as an EEPROM or a standby RAM.

The routine proceeds to step 108 wherein an error flag F2 is set to one (1) indicating the presence of the error of the internal drive voltage Vin and stored in a RAM. When the error flag F2 is zero (0), it means that the internal drive voltage Vin is correct. The error flag F2 is initialized to zero (0) in the initial operation of the microcomputer 21.

If it is determined that the internal drive voltage Vin is in error or that the count C has reached the number of times K, the routine executes step 109. In other words, when a condition where the internal drive voltage error determination should be terminated is met, the monitor flag F1 is set to one (1) to inhibit this program from being initiated upon a subsequent start-up of the engine 10.

Figure 5:
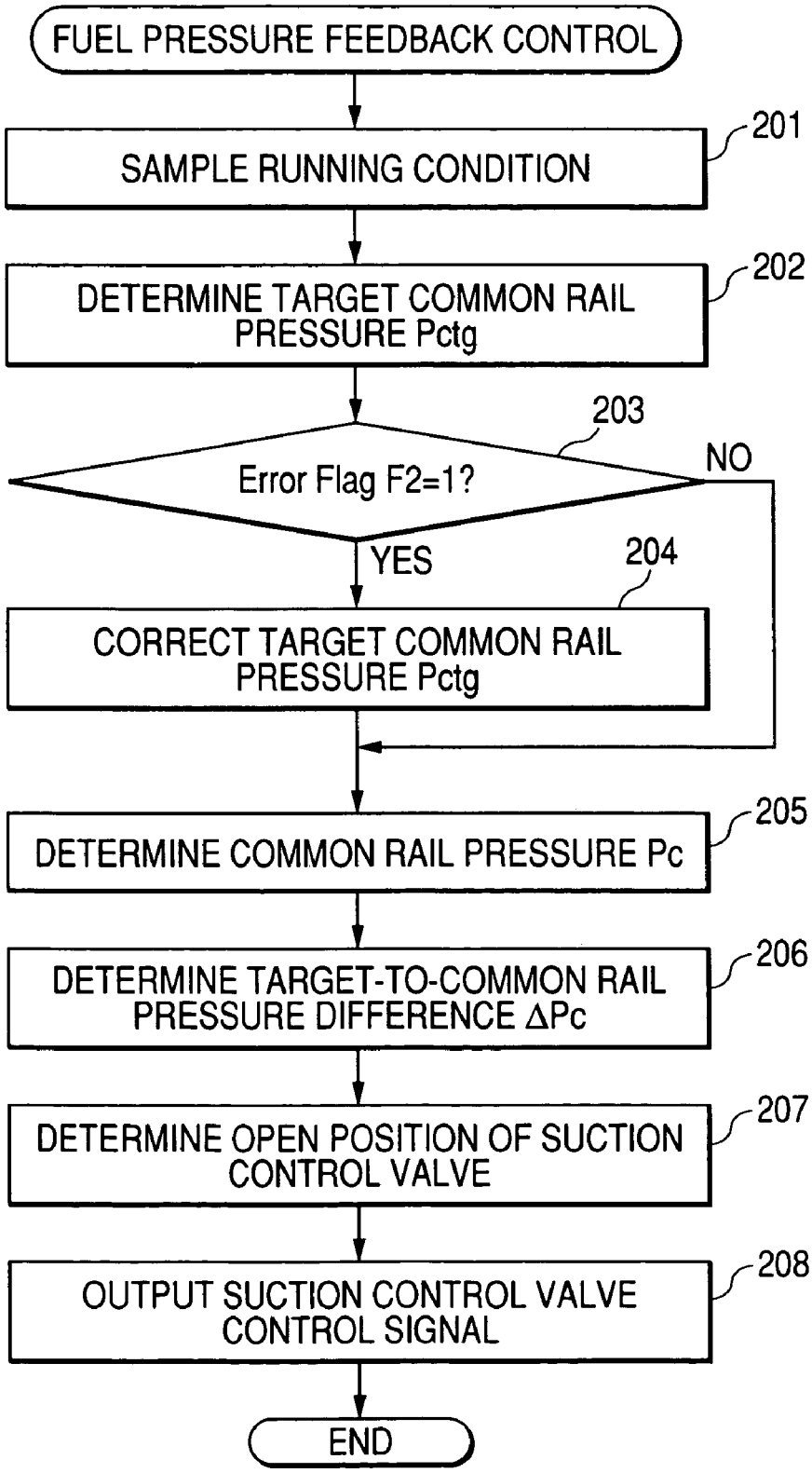
FIG. 5 is a flowchart of a feedback control program to control the pressure of fuel in a common rail using results of the drive voltage error determination in FIG. 4.

FIG. 5 is a flowchart of a feedback control program to control the pressure of the fuel in the common rail 12 using results of the internal drive voltage error determination in FIG. 4. This program is executed by the microcomputer 21 in a cycle of, for example, 10 msec.

After entering the program, the routine proceeds to step 201 wherein engine running information on the speed of the engine 10 and the quantity of the fuel to be injected into the engine 10 is sampled.

The routine proceeds to step 202 wherein the target common rail pressure Pctg is determined based on the speed of the engine 10 and the quantity of the fuel to be injected into the engine 10, as sampled in step 201, by look-up using a map listing a relation between the speed of the engine 10 and the quantity of the fuel to be injected into the engine 10.

The routine proceeds to step 203 wherein it is determined whether the error flag F2 is one (1) or not. If a YES answer is obtained (i.e., F2=1) meaning that the internal drive voltage Vin of the fuel pressure sensor 16 is in error, then the routine proceeds to step 204 wherein the target common rail pressure Pctg is corrected to a minimum value (e.g., 20 Mpa) required to ensure the operation of the engine 10, that is, permit the engine 10 to continue to run. Alternatively, if a NO answer is obtained (i.e., F2=0) in step 203 meaning that the internal drive voltage Vin of the fuel pressure sensor 16 is not in error or after step 204, then the routine proceeds to step 205.

In step 205, the voltage signal Vout, as outputted from the fuel pressure sensor 16, is sampled to determine the pressure of the fuel within the common rail 12 (i.e., the common rail pressure Pc) by look-up using the map of FIG. 3. The routine proceeds to step 206 wherein a difference ΔP between the target common rail pressure Pctg and the common rail pressure Pc is calculated. The routine proceeds to step 207 wherein a target quantity of the fuel to be discharged by the high-pressure pump 13 which is required to eliminate the pressure difference ΔP is determined. A target open position of the suction control valve 13*a* is also determined which is required to achieve the target quantity of the fuel to be discharged by the high-pressure pump 13. The routine proceeds to step 208 wherein a control signal is outputted to the suction control valve 13*a* to bring the open position thereof into agreement with the target open position, as derived in step 207.

As apparent from the above discussion, when the resistor is disposed in the power supply line 31 between the fuel pressure sensor 16 and the ECU 20 in order to increase the output of the engine 10 or the harness 30 is disconnected from either of the fuel pressure sensor 16 or the ECU 20, it will cause the internal drive voltage Vin of the fuel pressure sensor 16 to be decreased by more than a certain level. The microcomputer 21 executes the internal drive voltage error monitoring program of FIG. 4 and determines that the internal drive voltage Vin is in error. The microcomputer 21 corrects the target common rail pressure Pctg to the minimum value required to ensure the operation of the engine 10 and determines the target quantity of fuel to be discharged from the suction control valve 13*a* which is required to achieve the corrected value of the target common rail pressure Pctg. This will cause the pressure of the fuel within the common rail 12 to be kept low, thus avoiding an undesirable rise in the pressure in the common rail 12 arising from the error of the internal drive voltage Vin of the fuel pressure sensor 16. This protects the common rail 12 and ensures the service life thereof.

Figure 6:
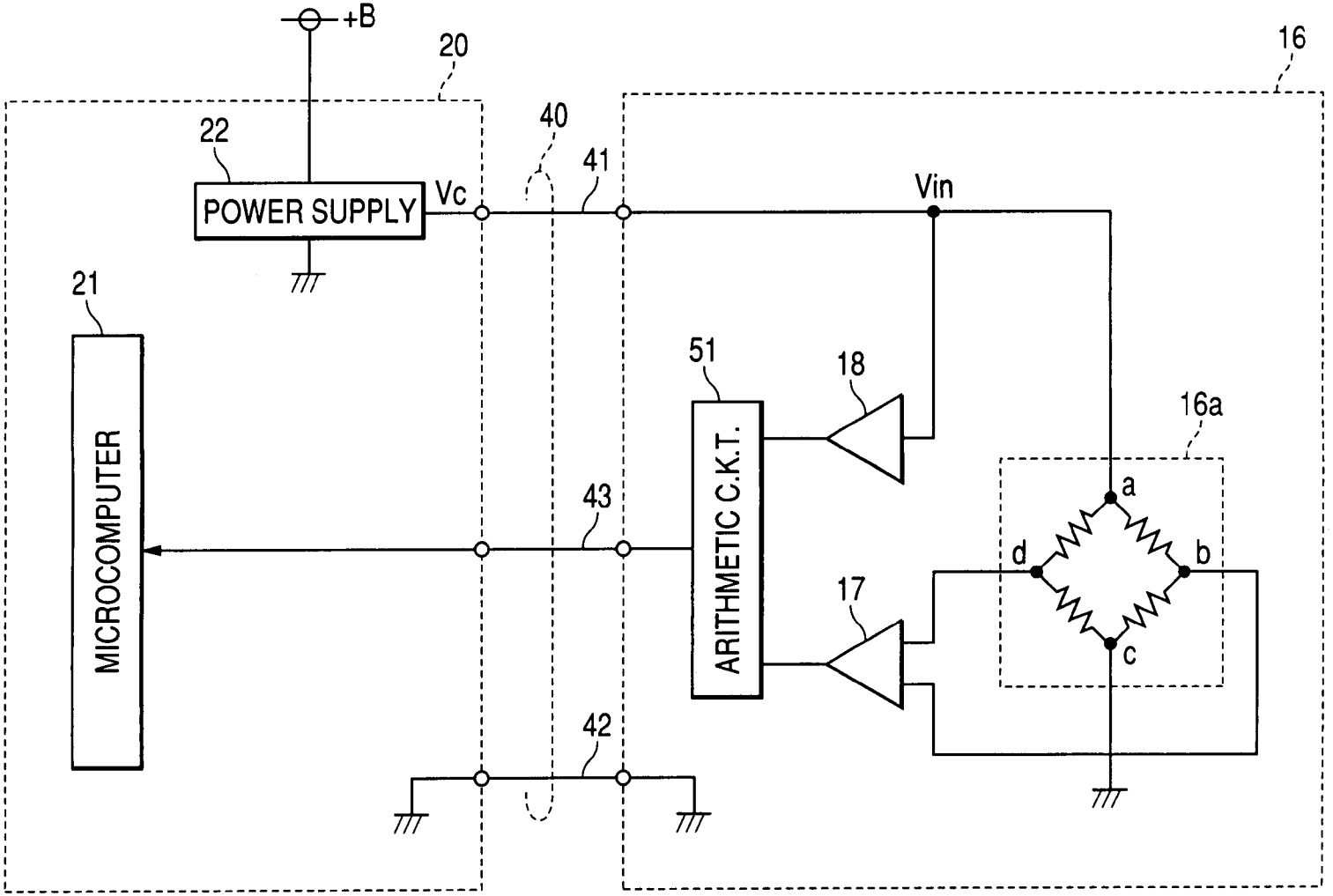
FIG. 6 is a circuit diagram which shows internal structures of an electronic control unit and a fuel pressure sensor according to the second embodiment of the invention.

FIG. 6 illustrates internal structures of the ECU 20 and the fuel pressure sensor 16 according to the second embodiment of the invention. The same reference numbers as employed in FIG. 2 refer to the same parts, and explanation thereof in detail will be omitted here.

The fuel pressure sensor 16 includes an arithmetic circuit 51 made by a microcomputer which works to determine whether the internal drive voltage Vin is in error or not.

The fuel pressure sensor 16 and the ECU 20 are coupled with each other through a harness 40. The harness 40 consists of three wires and connectors (not shown) joined to ends of the wires. The fuel pressure sensor 16 and the ECU 20 also have connectors mating with the connectors of the harness 40. The ECU 20 includes the power supply circuit 22 which supplies the electric power to the fuel pressure sensor 16 through the power supply line 41. The fuel pressure sensor 16 and the ECU 20 are kept at a common reference potential through the reference potential line 42.

The operational amplifier 18 samples and outputs the internal drive voltage Vin, as applied across the terminals a and c of the sensor element 16*a*, to the arithmetic circuit 51 through an A/D converter (not shown). The differential amplifier 17 samples and outputs the voltage developed across the terminals b and d of the sensor element 16*a* to the arithmetic circuit 51 through an A/D converter. The arithmetic circuit 51 determines a voltage ratio of the internal drive voltage Vin to the voltage appearing across the terminals b and d of the sensor element 16*a* and outputs a signal indicative thereof to the ECU 20 through the signal line 43.

The arithmetic circuit 51 calculates a percentage of the internal drive voltage Vin to the power supply voltage Vc and determines whether a drop in the internal drive voltage Vin from the power supply voltage Vc is within 10% or not. If such a drop lies out of 10%, the arithmetic circuit 51 determines that the internal drive voltage Vin is in error and sets the voltage ratio to be outputted to the ECU 20 to a given error value (e.g., 0).

The microcomputer 21 of the ECU 20 samples the voltage ratio, as transmitted from the arithmetic circuit 51 through the signal line 43, and executes the fuel pressure feedback control program of FIG. 5. Specifically, in step 203, the microcomputer 21 determines whether the voltage ratio is the error value (e.g., 0) or not instead of use of the error flag F2. If the voltage ratio is the error value, the microcomputer 21 determines in step 205 the internal drive voltage Vin to be the power supply voltage Vc, derives the voltage signal Vout from the sampled voltage ratio, and determines the common rail pressure Pc by look-up using the map of FIG. 3 or using an experimentally obtained relation between input and output voltages of the sensor element 16*a*. Other operations are identical with those in the first embodiment, and explanation thereof in detail will be omitted here.

The arithmetic circuit 51 working to monitor an error of the internal drive voltage Vin of the pressure fuel sensor 16 is, as described above, installed in the pressure fuel sensor 16, thus resulting in a decrease in operation load on the microcomputer 21 of the ECU 20.

The arithmetic circuit 51 samples the output voltage of the sensor element 16*a* and determines the voltage ratio of the internal drive voltage Vin to the sampled output voltage to provide a signal indicative thereof to the ECU 20, thereby permitting the ECU 20 to calculate the common rail pressure Pc as a function of the internal drive voltage Vin.

Figure 7:
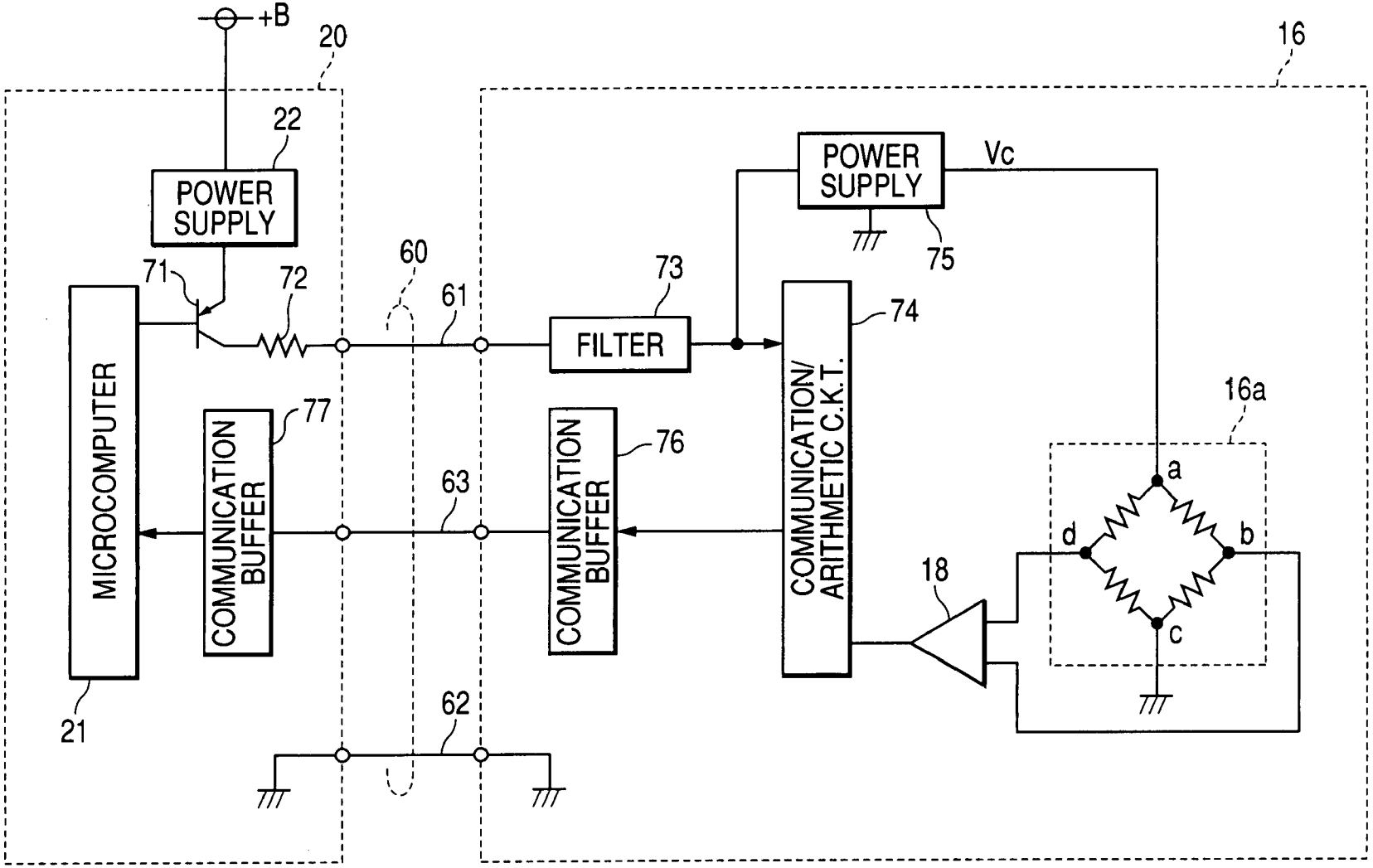
FIG. 7 is a circuit diagram which shows internal structures of an electronic control unit and a fuel pressure sensor according to the third embodiment of the invention.

FIG. 7 illustrates internal structures of the ECU 20 and the fuel pressure sensor 16 according to the third embodiment of the invention. The same reference numbers as employed in FIG. 2 refer to the same parts, and explanation thereof in detail will be omitted here.

The fuel pressure sensor 16 and the ECU 20 are coupled with each other through a harness 60. The harness 60 consists of three wires and connectors (not shown) joined to ends of the wires. The fuel pressure sensor 16 and the ECU 20 also have connectors mating with the connectors of the harness 40.

The ECU 20 is equipped with a transistor 71 and a resistor 72. The transistor 71 is connected at a base thereof to the microcomputer 21, at an emitter thereof to the power supply circuit 22, and at a collector thereof to the fuel pressure sensor 16 through the resistor 72 and the power supply line 61. The microcomputer 21, the power supply circuit 22, the transistor 71, and the resistor 72 constitute a power supply unit. The microcomputer 21 works to output on- and off-signals in a cycle to the transistor 71 to produce and provide a power signal made of a combination of electric power and clock signals to the fuel pressure sensor 16. The fuel pressure sensor 16 and the ECU 20 are kept at a common reference potential through the reference potential line 62.

The fuel pressure sensor 16 is equipped with a filter 73 and a communication/arithmetic circuit 74 which may be implemented by a microcomputer. The filter 73 works to remove electrical noises from the power signal outputted from the ECU 20. The communication/arithmetic circuit 74 extracts the clock signals from the power signal having passed through the filter 73. A power supply circuit 75 made up of a DC-DC converter and a smoothing circuit is connected to an output terminal of the filter 73. The power supply circuit 75 works to produce a constant power supply voltage Vc from a power supply signal and provide an electric power of the voltage Vc to the sensor element 16*a* and the communication/arithmetic circuit 74.

The communication/arithmetic circuit 74 works to sample the voltage signal Vout, as produced by the differential amplifier 17, through an A/D converter, codes the voltage signal Vout into communication data, and outputs it through a communication buffer 76 through serial communication. The communication data is inputted to the ECU 20 through the signal line 63 and acquired by the microcomputer 21 through a communication buffer 77. When coded, the communication data is added with a check code. The serial communication is achieved in synchronization with the clock signals inputted to the communication/arithmetic circuit 74.

The microcomputer 21 samples the communication data, as transmitted synchronously with the clock signals from the communication/arithmetic circuit 74, in the fuel pressure feedback control executed in a cycle of, for example, 10 msec. and decodes it to determine the common rail pressure Pc by look-up using the map of FIG. 3. The microcomputer 21 controls the open position of the suction control valve 13*a* to bring the determined common rail pressure Pc into agreement with the target value. Other operations are identical with those in the first embodiment, and explanation thereof in detail will be omitted here.

The fuel pressure sensor 16 of this embodiment is, as described above, equipped with the power supply circuit 75 designed to convert the inputted electric power into the electric power of the constant voltage Vc. The sensor element 16*a* is, therefore, applied with the constant voltage Vc. This causes the fuel pressure sensor 16 to produce an output regardless of a change in voltage applied to the fuel pressure sensor 16 which arises from the addition of the resistor in the power supply line 61 in order to increase the output of the engine 10 or disconnection of the harness 60 from the fuel pressure sensor 16 or the ECU 20, thus avoiding an error in determining the pressure of the fuel within the common rail 12. This enables the microcomputer 21 to perform the fuel pressure feedback control correctly, thus avoiding an undesirable rise in the pressure in the common rail 12 to protect the common rail 12 physically and ensures the service life thereof.

The ECU 20 supplies the cyclically varying electric power to the fuel pressure sensor 16. The fuel pressure sensor 16 transmits the communication data, as derived by coding the voltage signal Vout, to the ECU 20 through the serial communication. This requires, as described above, a need for analysis of the coding of the voltage signal Vout and the serial communication to produce the communication data when the fuel injection system is remodeled illegally or intentionally to elevate the pressure in the common rail 12 to increase the output of the engine 10, thereby resulting in increased difficulty in altering the output of the fuel pressure sensor 16 improperly.

The fuel injections system of the first or second embodiment may be modified below.

The determination of whether the internal drive voltage Vin is in error or not may be made by using a deviation of the internal drive voltage Vin from the power supply voltage Vc or comparing the internal drive voltage Vin with a threshold value, as determined based on the power supply voltage Vc.

In the program of FIG. 4, the internal drive voltage error determination is made during the steady operation of the engine 10 in order to increase the reliability thereof, but however, it may alternatively be made during an insteady operation of the engine 10, e.g., immediately after the start-up of the engine 10.

In the first embodiment, the microcomputer 21 is designed to sample the internal drive voltage Vin of the fuel pressure sensor 16 to perform the internal drive voltage error monitoring operation in FIG. 4, however, may alternatively be designed to sample through an A/D converter an output of a comparator to which the power supply voltage Vc and the internal drive voltage Vin are inputted through input terminals thereof, respectively. In this case, a criterion for determining whether the internal drive voltage Vin is in error or not may be set by selecting an offset of the comparator based on a given threshold.

In the first embodiment, when it is determined that the internal drive voltage Vin is in error, the target common rail pressure Pctg is corrected to the minimum value required to ensure the operation of the engine 10, but however, it may alternatively be corrected as a function of the internal drive voltage Vin. For instance, the target common rail pressure Pctg is decreased with a decrease in the internal drive voltage Vin (i.e., an increase in difference between the internal drive voltage Vin and the power supply voltage Vc). The pressure in the common rail 12 may alternatively be regulated under the feedback control using the common rail pressure Pc calculated based on a voltage ratio of the internal drive voltage Vin to the voltage signal Vout. In order to avoid an excessive raise in the common rail pressure Pc, the open-loop control may be performed instead of the fuel pressure feedback control or a fuel supply may alternatively be cut to stop the engine 10.

The arithmetic circuit 51 or the communication/arithmetic circuit 74 may be implemented by a special IC instead of the microcomputer or another type of electric circuit.

In the third embodiment, the power supply circuit 22 is used to supply the electric power to the fuel pressure sensor 16, but however, the electric power may be supplied directly from the terminal +B of the storage battery to the fuel pressure sensor 16.

The invention may also be used with a fuel injection system designed to accumulate gasoline in a common rail (also called a delivery pipe) and inject it into a cylinder injection gasoline engine.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A common rail fuel injection system comprising:

a common rail storing therein fuel under a given pressure which is to be injected into an engine;

a fuel pressure sensor equipped with a sensor element which works to output a voltage signal as a function of a pressure of the fuel within said common rail;

an electronic control unit equipped with a power supply circuit which is designed to supply a constant power supply voltage to said fuel pressure sensor through a harness, the constant power supply voltage being used in said fuel pressure sensor as a drive voltage applied to drive the sensor element, said electronic control unit working to feedback-control the pressure of the fuel within said common rail based on the voltage signal, as outputted from said fuel pressure sensor;

a voltage sampling circuit working to sample the drive voltage applied to the sensor element of said fuel pressure sensor; and a voltage error monitor working to monitor whether the drive voltage, as sampled by said voltage sampling circuit is within a given voltage level or not, and when the drive voltage is out of the given voltage level, said voltage error monitor determines that the drive voltage is in error;

wherein the harness connecting between said electronic control unit and said fuel pressure sensor includes a reference line through which said electronic control unit and said fuel pressure sensor are placed at a given reference potential, a first signal line through which the voltage signal is transmitted from said fuel pressure sensor to said electronic control unit, and a second signal line through which the drive voltage is transmitted from said fuel pressure sensor to said voltage sampling circuit installed in said electronic control unit.

2. A common rail fuel injection system as set forth in claim 1, wherein said electronic control unit determines a target fuel pressure with which the pressure within said common rail is brought into agreement under feedback control and corrects the target fuel pressure using the drive voltage, as sampled by said voltage sampling circuit.

3. A common rail fuel injection system as set forth in claim 1, wherein when it is determined by said voltage error monitor that the drive voltage, as sampled by said voltage sampling circuit, is in error, said electronic control unit corrects a target fuel pressure with which the pressure within said common rail is brought into agreement under feedback control to a value which is at least required to ensure an operation of the engine.

4. A common rail fuel injection system as set forth in claim 2, wherein when it is determined by said voltage error monitor that the drive voltage, as sampled by said voltage sampling circuit, is in error, said electronic control unit stops feedback control to control the pressure of the fuel within said common rail.

5. A common rail fuel injection system as set forth in claim 1, wherein said voltage error monitor works to monitor whether the drive voltage, as sampled by said voltage sampling circuit, is in error or not during a steady operation of the engine.

6. A common rail fuel injection system as set forth in claim 1, further comprising an arithmetic circuit which includes said voltage sampling circuit and said voltage error monitor and is installed in said fuel pressure sensor, said arithmetic circuit working to output to said electronic control unit a signal indicating the fact that the drive voltage, as sampled by said voltage sampling circuit, is in error.

7. A common rail fuel injection system as set forth in claim 1, wherein the drive voltage, as sampled by said voltage sampling circuit, is within the given voltage level when a drop in the drive voltage from the constant power supply voltage supplied through the harness is within a predetermined range.

8. A common rail fuel injection system as set forth in claim 7, wherein the predetermined range is 10% so that the drive voltage is within the given voltage level when the drop in the drive voltage from the constant power supply voltage supplied through the harness is within 10%.

* * * * *